US007267458B2

(12) United States Patent
Bin

(10) Patent No.: US 7,267,458 B2
(45) Date of Patent: Sep. 11, 2007

(54) KNOCK DOWN HARDBACK COLLAPSIBLE LAMPSHADE

(76) Inventor: Chou Shih Bin, 3rd Floor, No. 107, Chung Cheng Road, Sec. 1, Shihlin, Taipei (TW)

( * ) Notice: Subject to any disclaimer, the term of this patent is extended or adjusted under 35 U.S.C. 154(b) by 92 days.

(21) Appl. No.: 11/146,634

(22) Filed: Jun. 7, 2005

(65) Prior Publication Data

US 2006/0239011 A1 Oct. 26, 2006

Related U.S. Application Data

(63) Continuation-in-part of application No. 11/111,377, filed on Apr. 21, 2005.

(51) Int. Cl.
*F21V 1/06* (2006.01)

(52) U.S. Cl. ..... 362/352; 362/358

(58) Field of Classification Search ..... 362/352
See application file for complete search history.

(56) References Cited

U.S. PATENT DOCUMENTS 2,819,386 A * 1/1958 Linderoth ..... 362/352
3,764,801 A * 10/1973 Mainieks ..... 362/352
3,780,287 A * 12/1973 Fauri ..... 362/352
3,787,676 A * 1/1974 Korach ..... 362/352
4,055,760 A * 10/1977 Weisbrod ..... 362/352
4,383,291 A * 5/1983 Gall ..... 362/352
4,745,532 A * 5/1988 Mo ..... 362/352
6,561,682 B1 * 5/2003 Juang ..... 362/352

* cited by examiner

*Primary Examiner*—Jong-Suk (James) Lee
*Assistant Examiner*—Hargobind S. Sawhney
(74) *Attorney, Agent, or Firm*—Zito

(57) ABSTRACT

A lamp shade which can be collapsed to reduce its size for shipping, display and storage, having an upper ring, a lower rings, and a cover. The cover of the lampshade is relatively stiff, particularly when formed into a taught cone or cylinder. It is self supporting when assembled, but the cover may still be collapsed when disassembled for shipment or storage. In one embodiment, the rings are placed into corresponding upper and lower edges of the cover and held in place by press-fitting a plurality of fitting nubs protruding from the perimeter of the rings into sockets attached along the insides of the edges. In another embodiment, the rings are held in place by press-fitting the band of the rings between jaws of a plurality of clips placed around the edges. In a third embodiment, the rings are held in place by a combination of the above two methods.

12 Claims, 17 Drawing Sheets

KNOCK DOWN HARDBACK COLLAPSIBLE LAMPSHADE

RELATED APPLICATIONS

This application is a continuation-in-part of application Ser. No. 11/111,377 filed Apr. 21, 2005, now pending. This application is also related to U.S. application Ser. No. 10/615,496 filed Jul. 8, 2003, now U.S. Pat. No. 6,851,836 issued Feb. 8, 2005; and No. 10/274,699 filed Oct. 18, 2002, now U.S. Pat. No. 6,685,344 issued Feb. 3, 2004.

FIELD OF THE INVENTION

The present invention relates to lampshade frames which are covered with a flexible material and can be collapsed to occupy less space during shipping and storage. More specifically, the present invention is a strut-free, collapsible lampshade with a cover, a removable upper and lower ring, and a mounting spider with a mounting hub for mounting the lampshade on a lamp base.

BACKGROUND OF THE INVENTION

A significant part of the sales price of a table lamp arises from the cost of transporting the lamp from the manufacturing plant to the retail sales store or to the purchaser and the cost for inventory space, shelf space and storage space. Because the bulky shape of the shade comprises a substantial portion of the lamp's total packaging volume, the assembled shade often disproportionately affects the shipping, display and storage cost and ultimately the sales price of the lamp.

Prior art contains examples of collapsible shades, which depend on the stiffness of a removable frame to hold the shape of the shade after assembly. Prior art frames contain support rings, radial struts and vertical struts. The frame contributes a significant cost to the overall shade and in certain embodiments, it can be quite difficult to assemble. The present invention is designed to trim the ultimate cost of the lampshade by reducing the structural components in the frame. The frame reduction will also simplify the lampshade's assembly.

SUMMARY OF THE INVENTION

A collapsible lampshade is disclosed having an upper ring and a lower ring, and a flexible cover, such as cloth, fabric or paper removably attached to the upper and lower rings. The cover is made from a thin sheet of material, generally flexible, but relatively stiff when formed into a taught cylindrical or conical shape. The upper and lower rings comprise circular-shaped bands, which fit snugly into respective upper and lower edges of the shade. With the rings installed, the upper and lower edges of the cover are stretched taught and the cover stiffens into its assembled lampshade shape. The rings are removed from the shade to allow the shade to be collapsed. A mounting spider assembly spans either the upper or lower ring to facilitate mounting the lampshade onto a variety of lamps. The mounting spider comprises a plurality of legs and a mounting hub, and is manufactured as either a planar or conical-shaped structure. All embodiments of the invention include either socket or clip-type ring holders at the top and bottom inside edges of the lampshade to fix and hold the rings in place when the shade is assembled.

Each of the components of the lampshade as discussed above comes in one or more embodiments. A great number of embodiments of the composite lampshade may be obtained from mixing various embodiments of each of its components.

In a first embodiment of the cover, it is comprised of a thin sheet of material of a generally flexible nature, but becoming relatively stiff when formed into a cylindrical or conical lampshade-shape. Affixed to the inside of the upper and lower edges of the cover are a plurality of ring holders, used to hold the respective upper and lower rings in place at their respective edges. In this embodiment, the cover is manufactured as a single unit with a permanently locked seam running longitudinally between its upper and lower edges.

In a second embodiment, the cover comprises one or a plurality of cover segments separated along longitudinal seams. The segments are connected together, forming a complete cover, via a seam joining mechanism, such as an alternating, opposing flap interlocking system.

A first embodiment of the ring holders comprise a plurality of socket-type attachments affixed at equidistant intervals to the inside of the upper and/or lower edges of the cover. The sockets are affixed with their socket openings facing inward, toward the center of the edge of the shade.

In a second embodiment, the ring holders comprise clip-type attachments affixed at equidistant intervals to the inside of the upper and/or lower edges of the cover. The clips generally comprise a pair of jaws, running parallel to the plane of the top and bottom of the assembled shade, and spaced apart and configured to accept either an upper or lower ring in a non-slip manner.

In a third embodiment of the ring holders, they comprise a combination of both the socket and clip holders.

In a first embodiment of the upper and lower rings, the circular band is deformed with indentations at regular intervals. Permanently affixed within the depression of the indentation is a fixing nub, comprising a solid ball or other shape of material, sized to seat securely into the sockets of the socket-type ring holders. This embodiment of the rings is designed for use with either the socket-type ring holders alone, or with the combination of socket and clip-type ring holders. In either application, the rings are pressed into the inside edges of their associated upper or lower cover edges with the fixing nubs oriented into the socket openings of the socket-type holders. In the case of the combination holder embodiment, the rings are simultaneously pressed in between the jaws of the clips.

In a second embodiment, the rings have no indentations. In this embodiment, the rings are used with the clip-type ring holder attachments alone.

In a third embodiment of the rings, the first two embodiments may be designed such that the lower ring is comprised of a plurality of radially curved sections. Each section of the ring is connected to the others through the use of a ring connector, such as a plastic tube of an inner diameter suited to tightly fit the outer diameter of each end of two ring sections to be joined.

In a first embodiment of the mounting spider, the spider comprises a central mounting hub and a plurality of legs extending radially outward therefrom. The hub and legs exist in a single plane. The legs are attached to the upper ring at the inside edge of the ring's circular band. In the case of rings with indentations, the legs may be attached to the rings at those points, opposite the mounting nubs.

In a second embodiment of the spider, the legs may be oriented conically relative to the mounting hub. The legs of the spider in this embodiment may be attached to either the upper or lower rings in a similar manner to those of the first embodiment.

In a third embodiment of the spider, the legs may extend for a distance in a plane away from the mounting hub before bending into a truncated conical arrangement.

In the cases of either conical or truncated conical spider arrangements, the tip (small end) of the cone projects into the interior of the assembled shade.

BRIEF DESCRIPTION OF THE DRAWINGS

Exemplary embodiments of the invention are discussed hereinafter in reference to the drawings, in which.

DETAILED DESCRIPTION OF PREFERRED EXEMPLARY EMBODIMENTS

Figure 1:
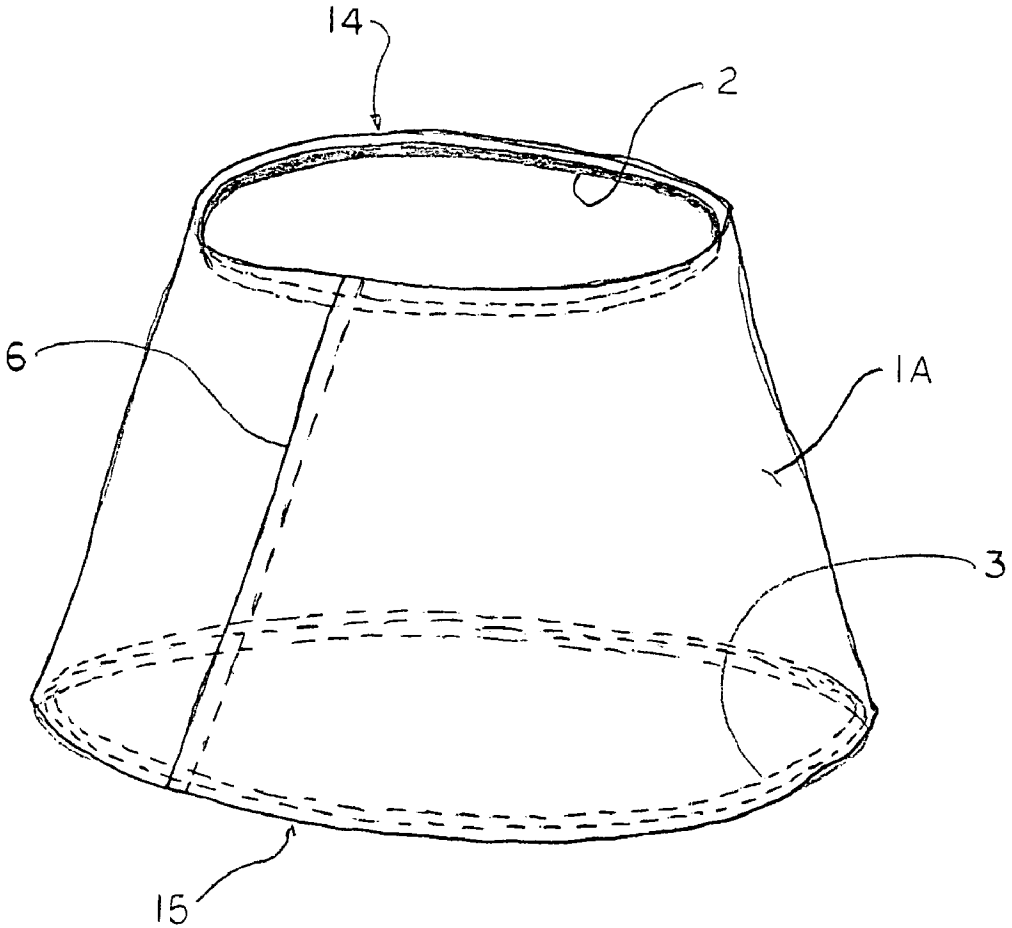
FIG. 1 an illustration of the lampshade of the present invention fully assembled.
Figure 11:
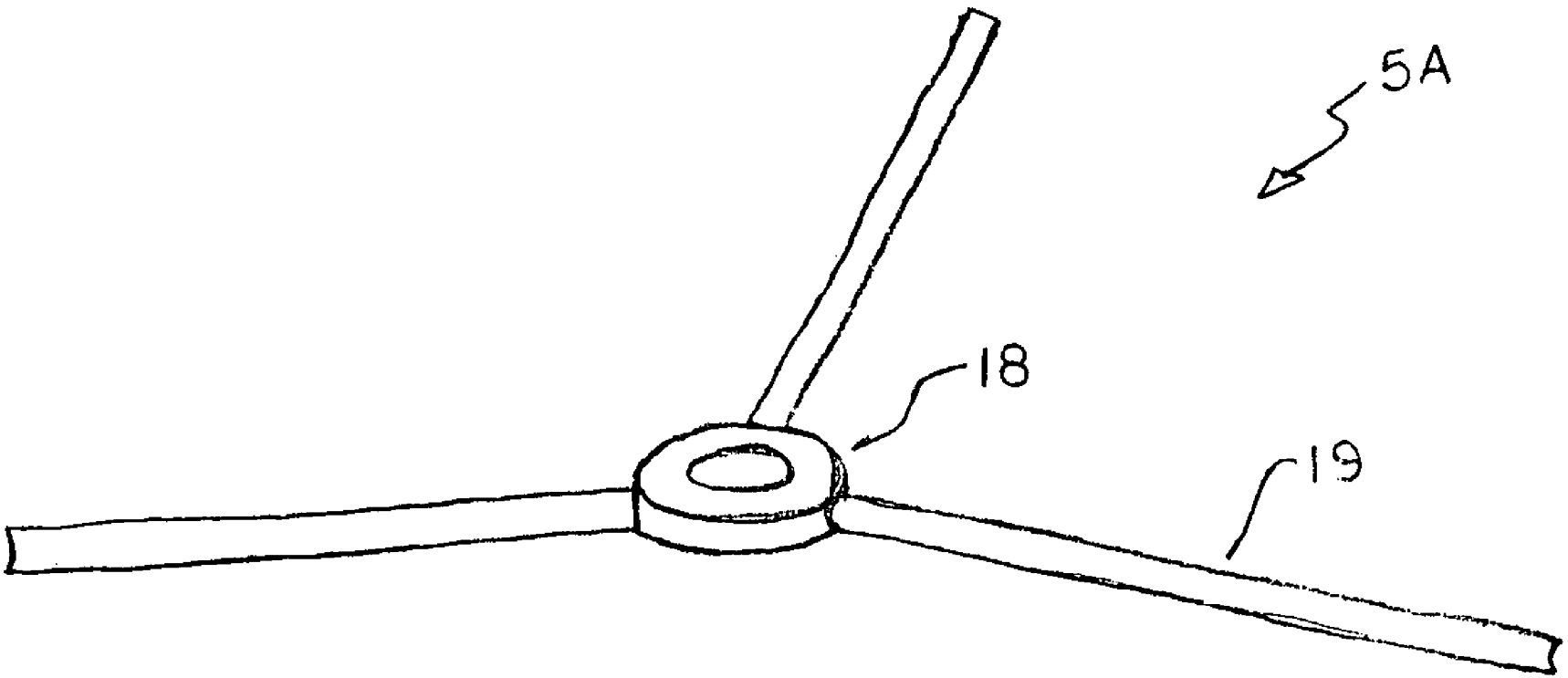
FIG. 11 is an illustration of the first embodiment of the mounting spider. It depicts a planar arrangement of the spider.
Figure 13:
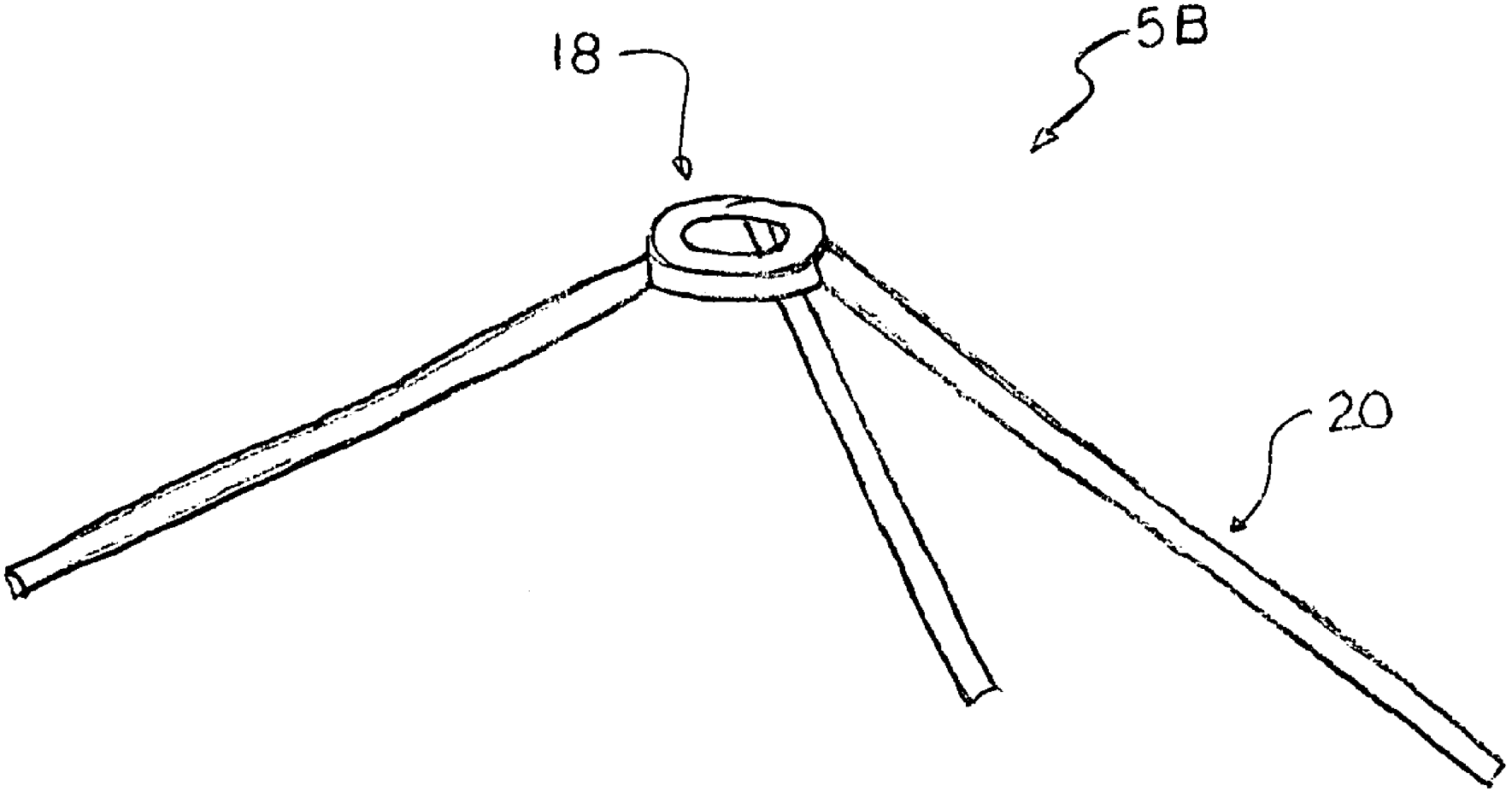
FIG. 13 is an illustration of the second embodiment of the mounting spider. It depicts a conical arrangement of the spider.
Figure 15:
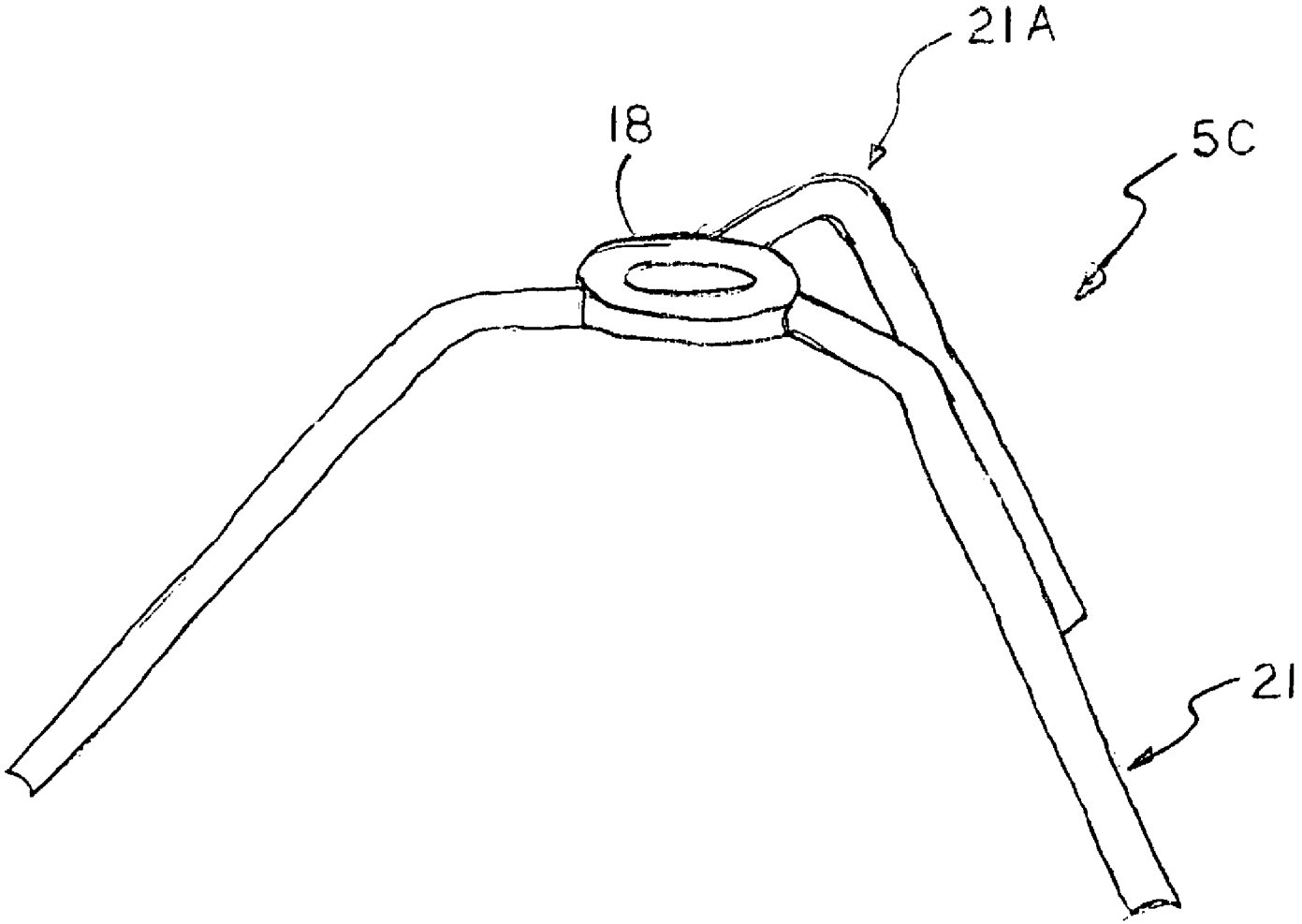
FIG. 15 is an illustration of the third embodiment of the mounting spider. It depicts a truncated conical arrangement of the spider.

The lampshade of the present invention comprises a plurality of arrangements consisting of combinations of various embodiments of the invention's primary and secondary constituent parts. The primary parts, as shown in FIG. 1, comprise a cover 1A, an upper ring 2, a lower ring 3. Secondary parts comprise a plurality of ring holders 4A and 4B (FIG. 2) and a mounting spider 5A-C (FIGS. 11, 13, 15). The description will begin with a description of the general embodiments of each of the primary and secondary constituents and will progress to an example of a composite shade arrangement utilizing a combination of these parts.

In a first embodiment, as shown in FIG. 1, the cover 1A is comprised of a thin sheet of material of a generally flexible nature. The cover may be made of paper, plastic or any other type of material which becomes relatively stiff when formed into a cylindrical or conical shape. In this embodiment, cover 1A is manufactured as a single unit with a permanently locked seam 6 running longitudinally between its upper and lower edges 14 and 15, respectively.

Figure 4:
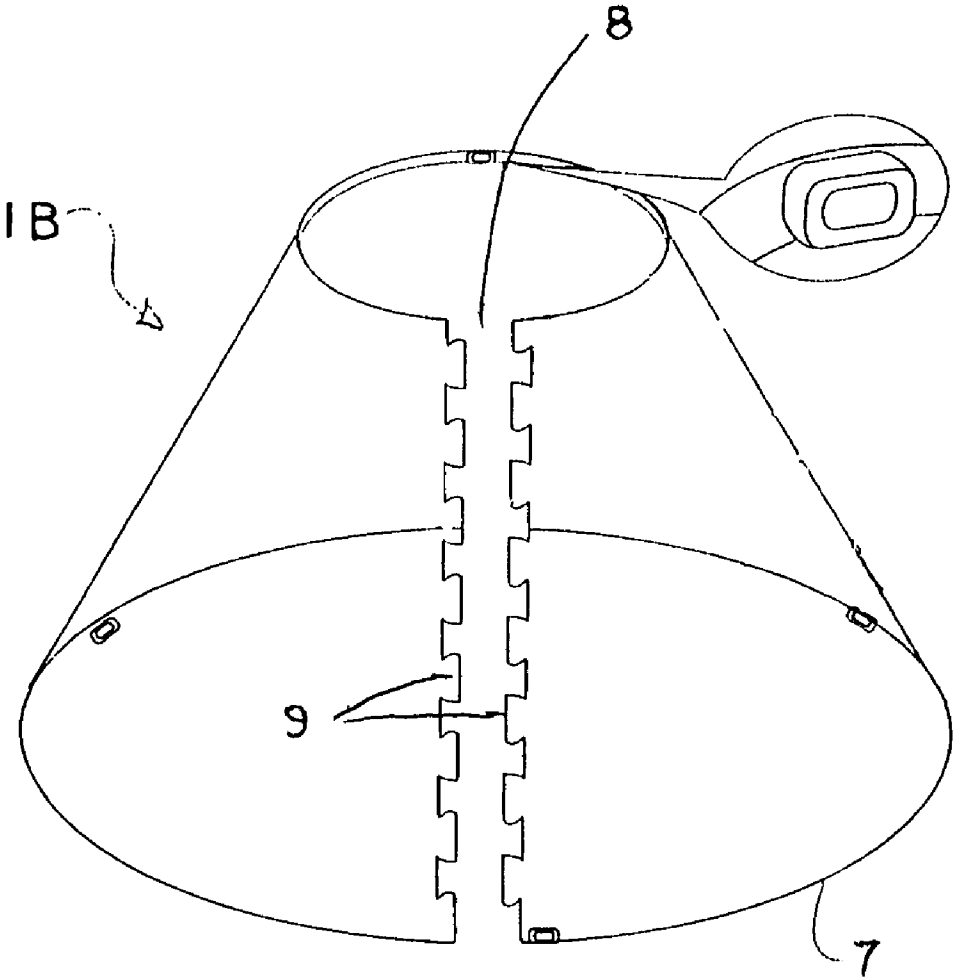
FIG. 4 is an illustration of a lampshade cover with seam joining mechanism. The drawing depicts an alternating, opposing flap interlocking system.

In a second embodiment, as shown in FIG. 4, the cover 1B comprises one or a plurality of cover segments 7 separated along one or more longitudinal seams 8. The ends of the segments are connected together, forming a complete cover, via a seam joining mechanism, such as an alternating, opposing flap interlocking system 9.

Figure 2:
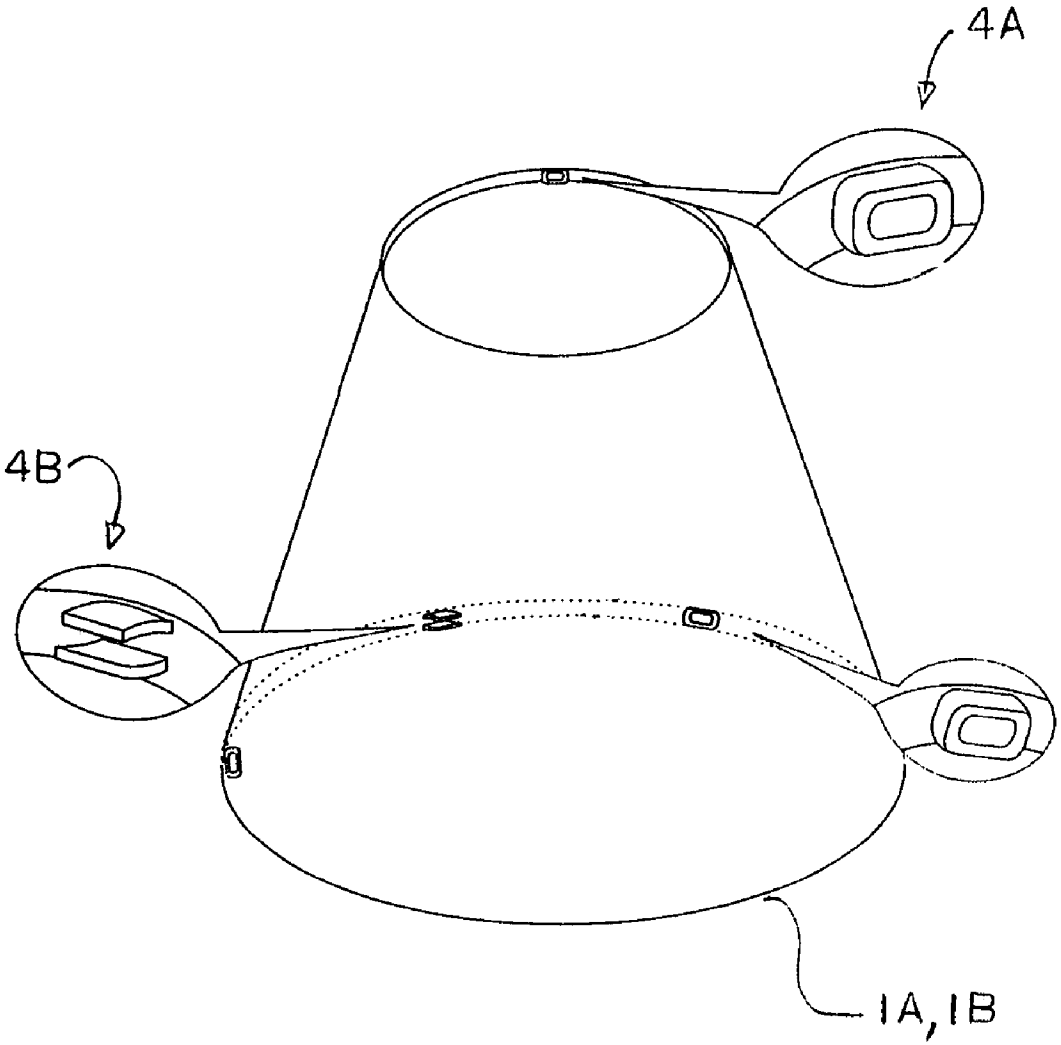
FIG. 2 is an illustration of the two different embodiments of the ring holders. These are the socket and clip-type attachments.

As shown in FIG. 2, a plurality of ring holders 4A and 4B are affixed to the inside of the upper and lower edges of cover 1A or 1B. The ring holders are used to hold the respective upper and lower rings in place at their respective edges.

Figure 5A:
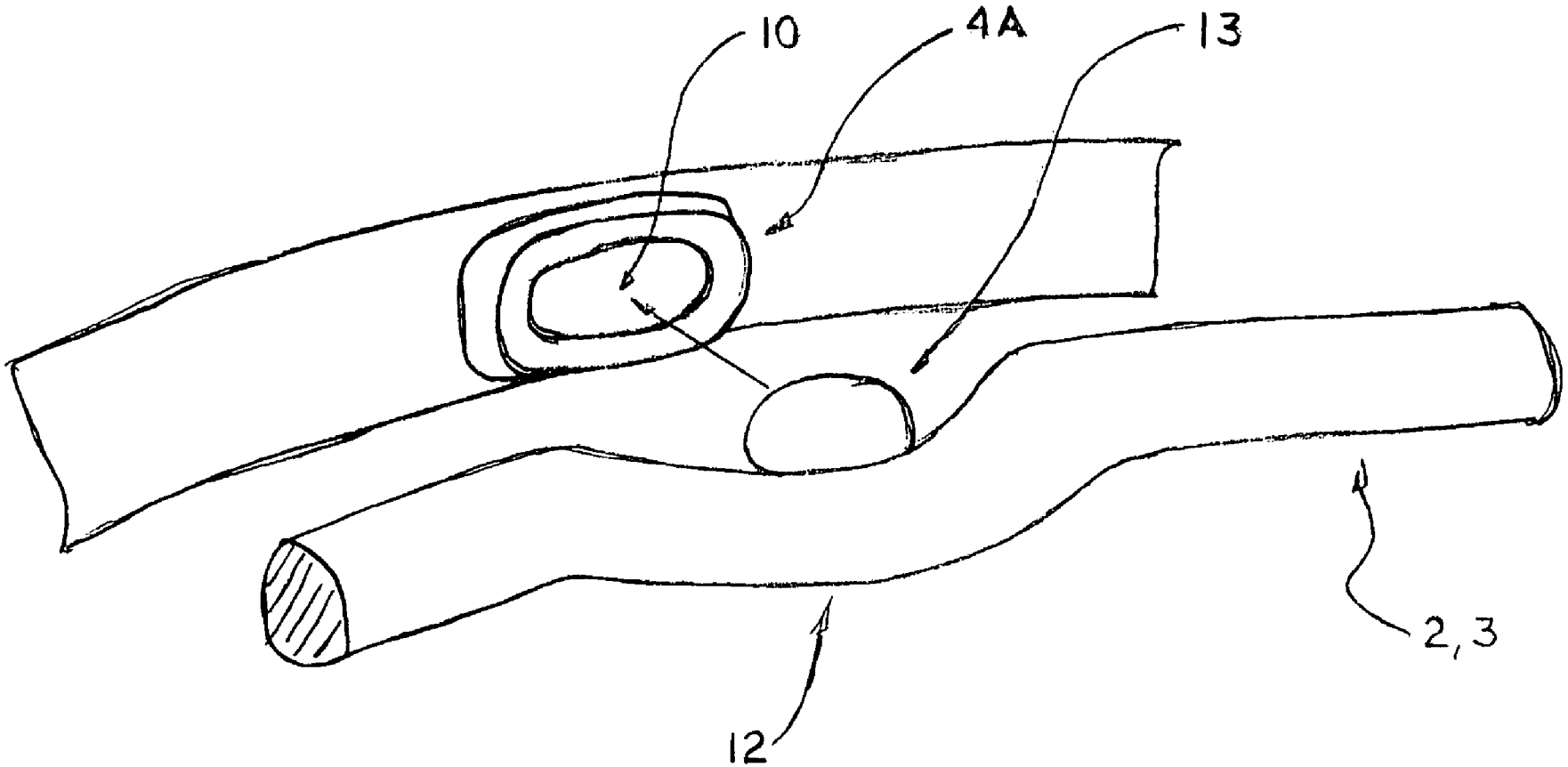
FIG. 5A is an illustration of the first embodiment of the ring holder. This illustration depicts the socket-type holder.

A first embodiment of the ring holders comprise a plurality of socket-type attachments 4A affixed at equidistant intervals to the inside of the upper and/or lower edges of the cover. As shown in FIG. 5A, the sockets 4A are affixed to the upper and/or lower edges of the cover with their socket openings 10 facing inward, toward the center of the edge of the shade.

Figure 5B:
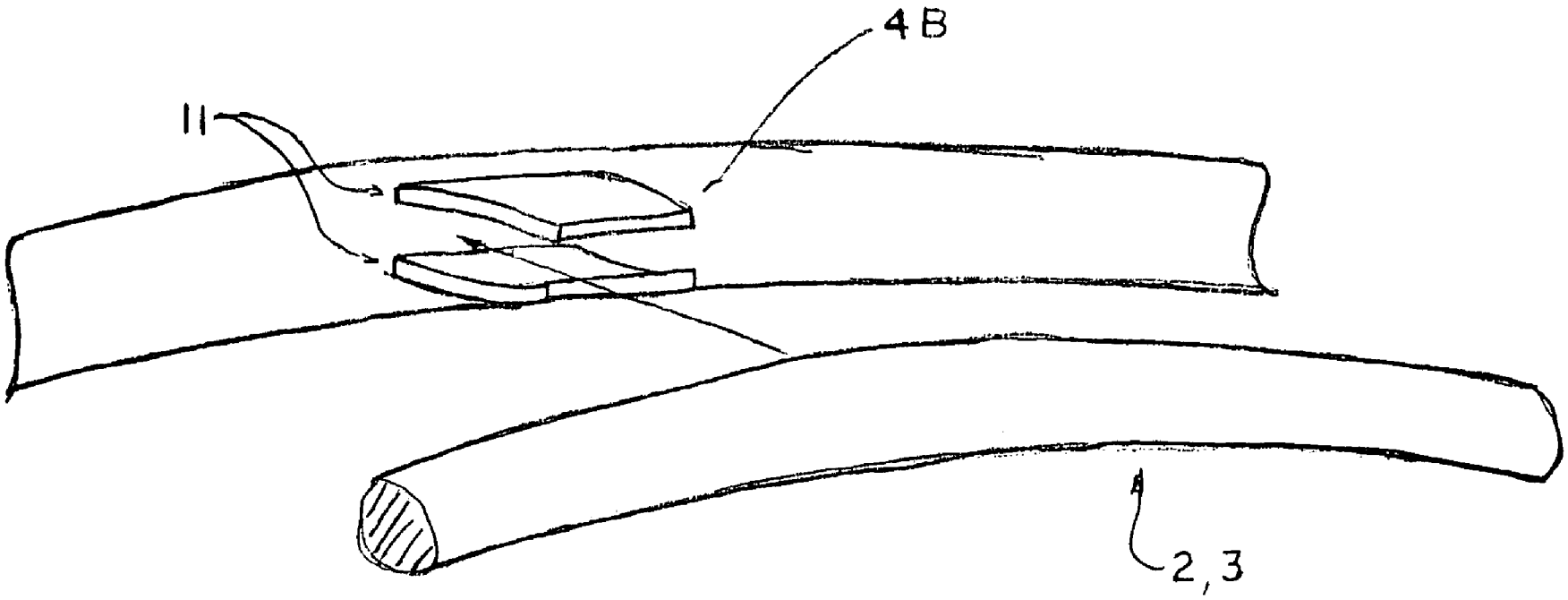
FIG. 5B is an illustration of the second embodiment of the ring holder. This illustration depicts the clip-type holder.

In a second embodiment, the ring holders comprise clip-type attachments 4B affixed at equidistant intervals to the inside of the upper and/or lower edges of the cover. As shown in FIG. 5B, the clips 4B generally comprise a pair of jaws 11, running parallel to the plane of the top and bottom of the assembled shade, and spaced apart and configured to accept either an upper or lower ring 2 or 3 in a non-slip manner.

In a third embodiment of the ring holders, as shown in FIG. 2, they comprise a combination of both the socket 4A and clip 4B holders.

Figure 6:
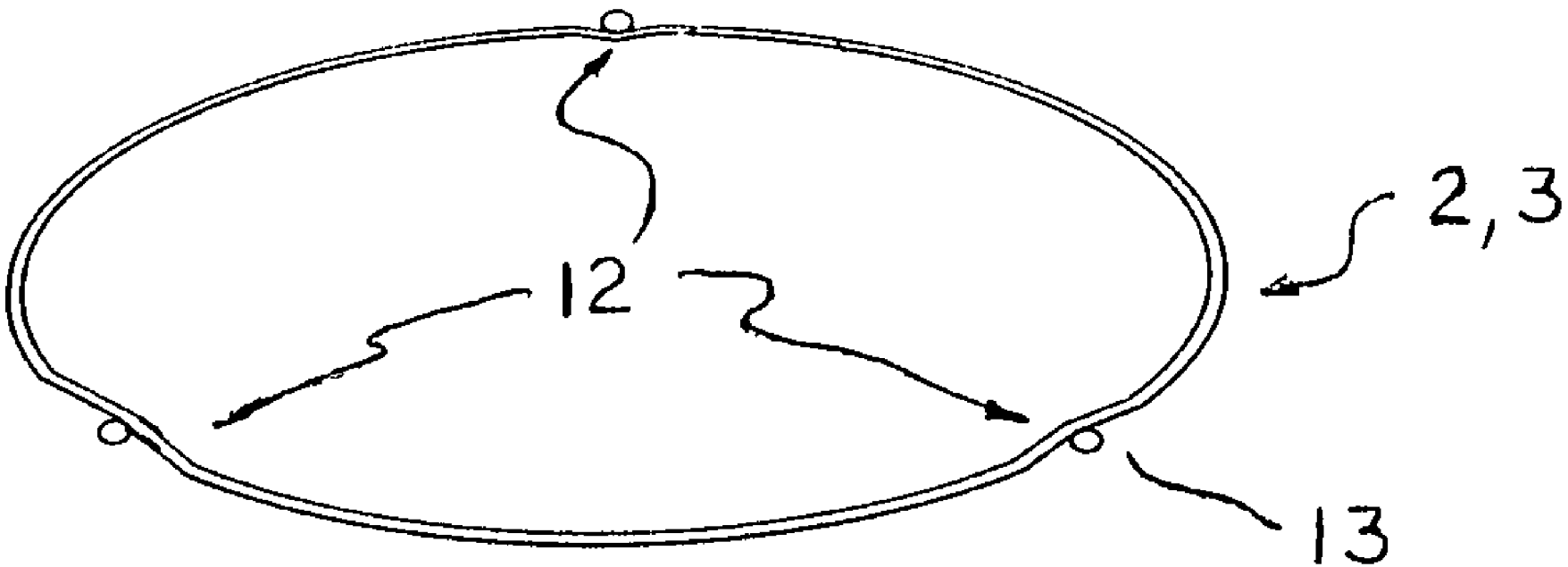
FIG. 6 is an illustration of the first embodiment of the upper (or lower) ring with positioning indentations and fixing nubs.
Figure 8:
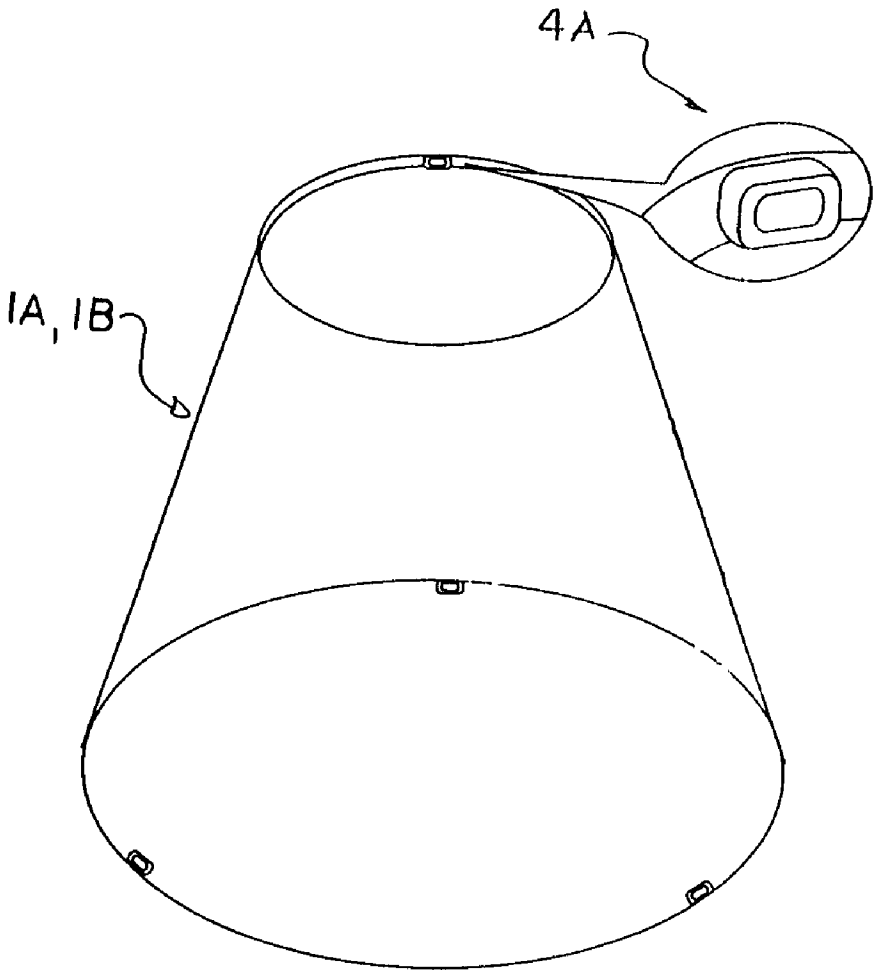
FIG. 8 is an illustration of a cover with the first embodiment of the ring holder. This illustration depicts a plurality of the socket-type holders.

In a first embodiment of the upper and lower rings 2 or 3, as shown in FIG. 6, the circular band is deformed with indentations 12 at regular intervals. Permanently affixed within the depression of indentation 12, as shown in FIG. 5A, is a fixing nub 13, comprising a solid ball or other shape of material, sized to seat securely into socket holes 10 of sockets 4A. This embodiment of rings 2 and 3 is designed for use with either the socket 4A holders alone (FIG. 8), or with the combination of socket and clip 4B holders (FIG. 2). In either application, the rings are pressed into the inside surfaces of their associated upper or lower cover edges 14 and 15 with the fixing nubs 13 oriented into the socket openings 10 of the socket-type holders 4A as indicated in FIG. 5A. In the case of the combination holder 4A and 4B embodiment (FIG. 2), the rings are simultaneously pressed in between the jaws 11 of the clips 4B.

Figure 7:
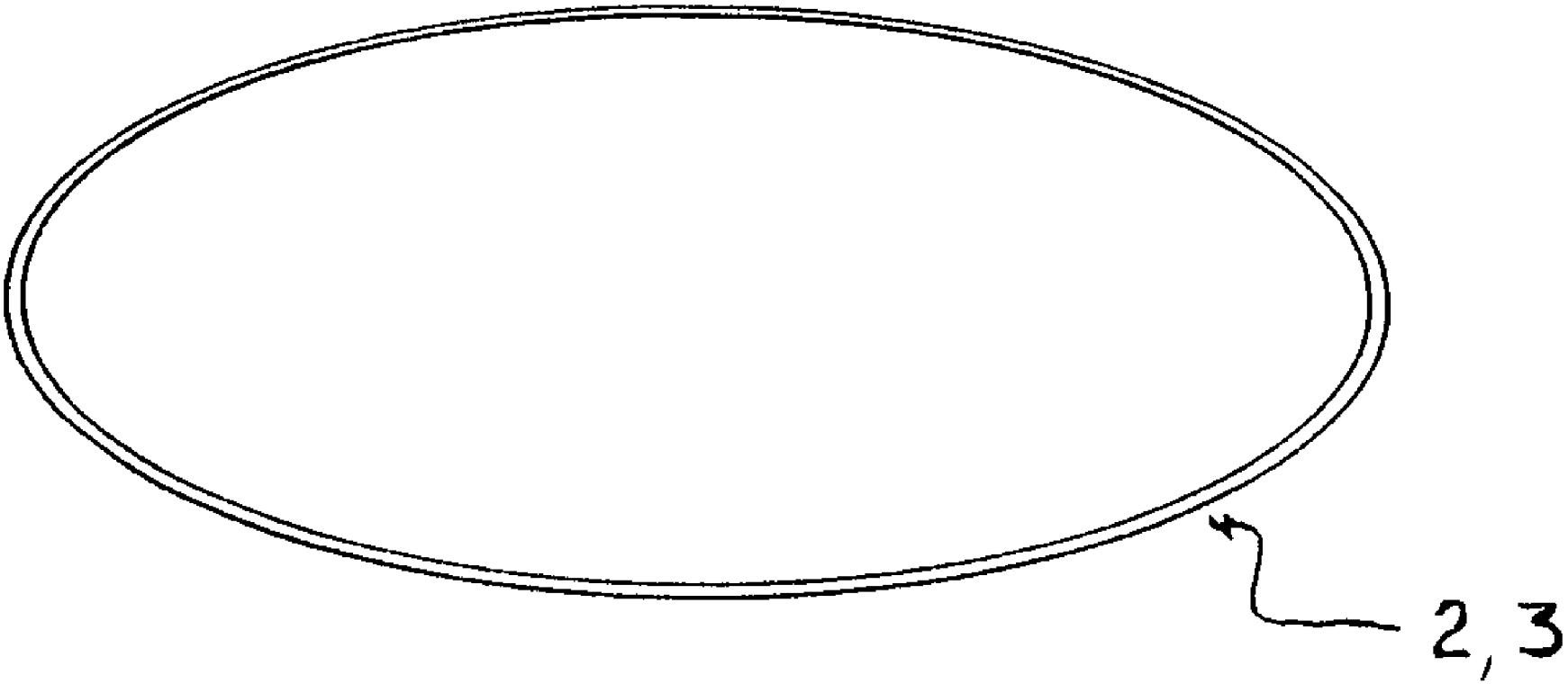
FIG. 7 is an illustration of the second embodiment of the upper (or lower) ring without indentations and fixing nubs.
Figure 9:
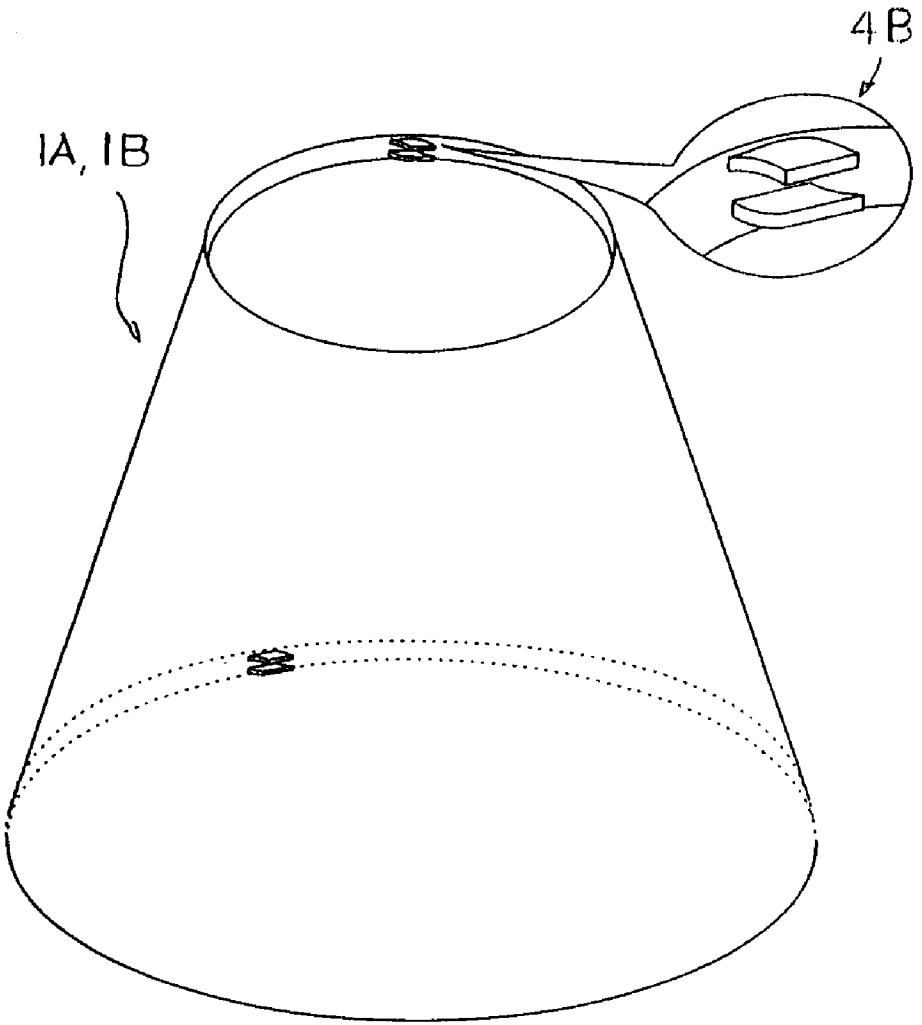
FIG. 9 is an illustration of a cover with the second embodiment of the ring holder. This illustration depicts a plurality of the clip-type holders.

In a second embodiment, rings 2 and 3 have no indentations. In this embodiment, as shown in FIG. 7, the rings are used with the clip-type ring holder attachments 4B alone (FIG. 9).

Figure 10:
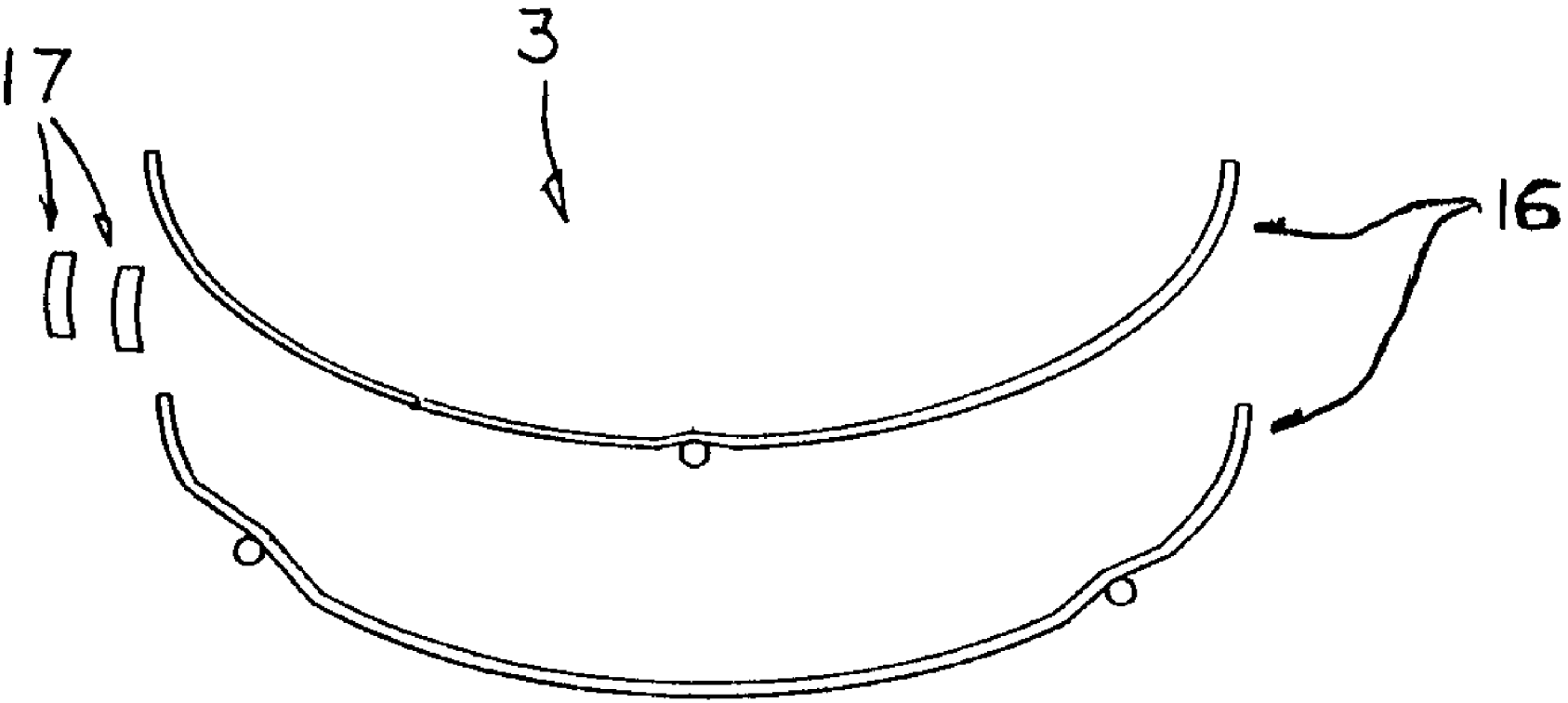
FIG. 10 is an illustration of the third embodiment of the lower ring. This drawing shows a two-section indented ring with a pair of (detached) plastic tube connectors.

In a third embodiment of the rings, the first two embodiments may be designed such that the lower ring 3 is comprised of a plurality of radially curved sections 16. This embodiment is shown in FIG. 10. Each section of the ring is connected to the others through the use of a ring connector 17, such as a plastic tube of an inner diameter suited to tightly fit the outer diameter of each end of two ring sections to be joined.

Figure 12:
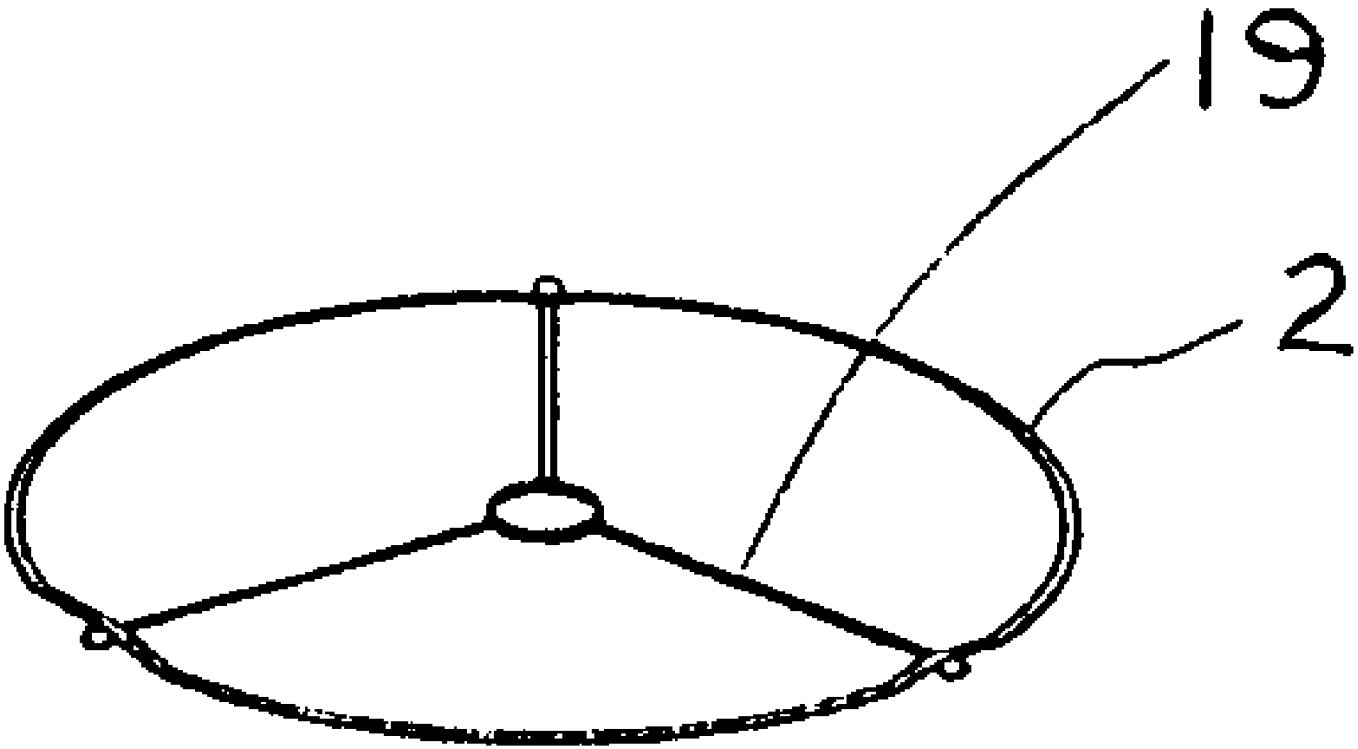
FIG. 12 is an illustration of the first embodiment of the mounting spider installed into the first embodiment of the upper ring. This is a planar spider arrangement.

In a first embodiment, as shown in FIG. 11, the mounting spider 5A comprises a central mounting hub 18 and a plurality of legs 19 extending radially outward therefrom. The hub and legs exist in a common plane. As shown in FIG. 12, the legs are attached to the upper ring at the inside edge of the ring's circular band. In the case of rings with indentations, the legs may be attached to the rings at those points, opposite the mounting nubs.

Figure 14:
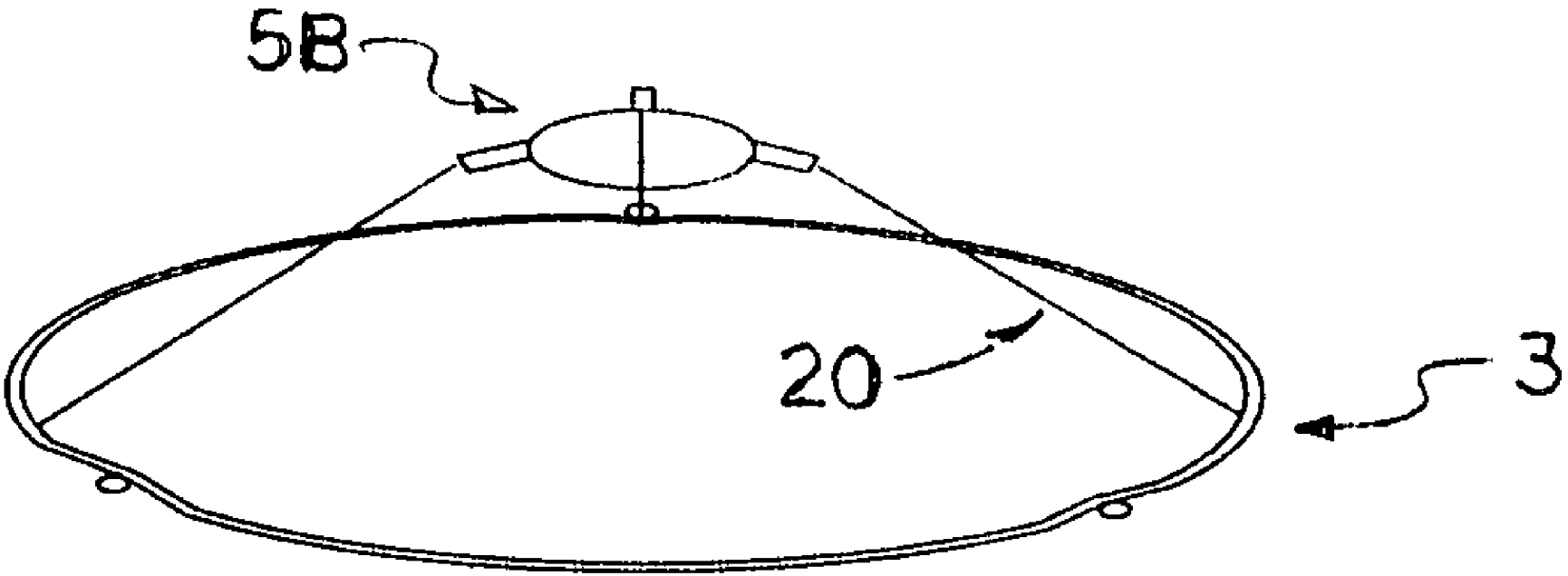
FIG. 14 is an illustration of the second embodiment of the mounting spider installed into the first embodiment of the bottom ring. This is the conical spider arrangement.

In a second embodiment, spider 5B, as shown in FIG. 13, comprises legs 20 which may be oriented conically relative to the mounting hub 18. Hub 18 forms the tip of the cone. The legs of the spider in this embodiment may be attached to either the upper or lower rings in a similar manner to those of the first embodiment. If the spider is mounted on a top ring, the tip of the cone projects downward into the interior of the lampshade. If the spider is mounted on the bottom ring, the tip projects upward. FIG. 14 depicts spider 5B attached to bottom ring 3.

Figure 16:
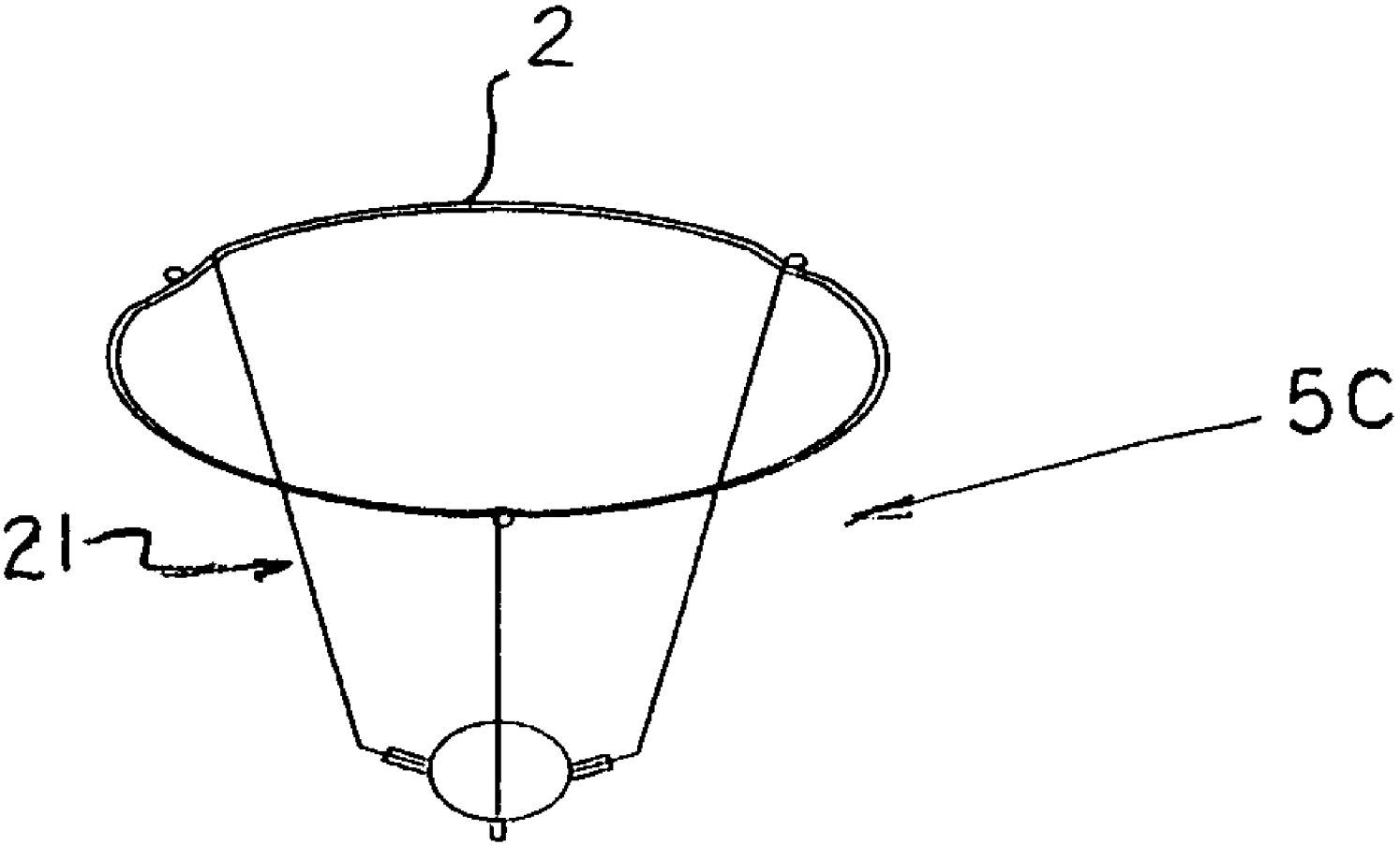
FIG. 16 is an illustration of the third embodiment of the mounting spider installed into the first embodiment of the upper ring. This is the truncated conical spider arrangement.

In a third embodiment, as shown in FIG. 15, spider 5C comprises hub 18 and bent legs 21. The legs may extend for a distance in a plane away from the mounting hub before being bent (21A) into a truncated conical arrangement. Similarly to the second spider embodiment, if spider 5C is mounted on a top ring 2, the tip of the truncated cone projects downward into the interior of the lampshade. If the spider is mounted on bottom ring 3, the tip projects upward. FIG. 16 depicts spider 5C attached to top ring 2.

Figure 3:
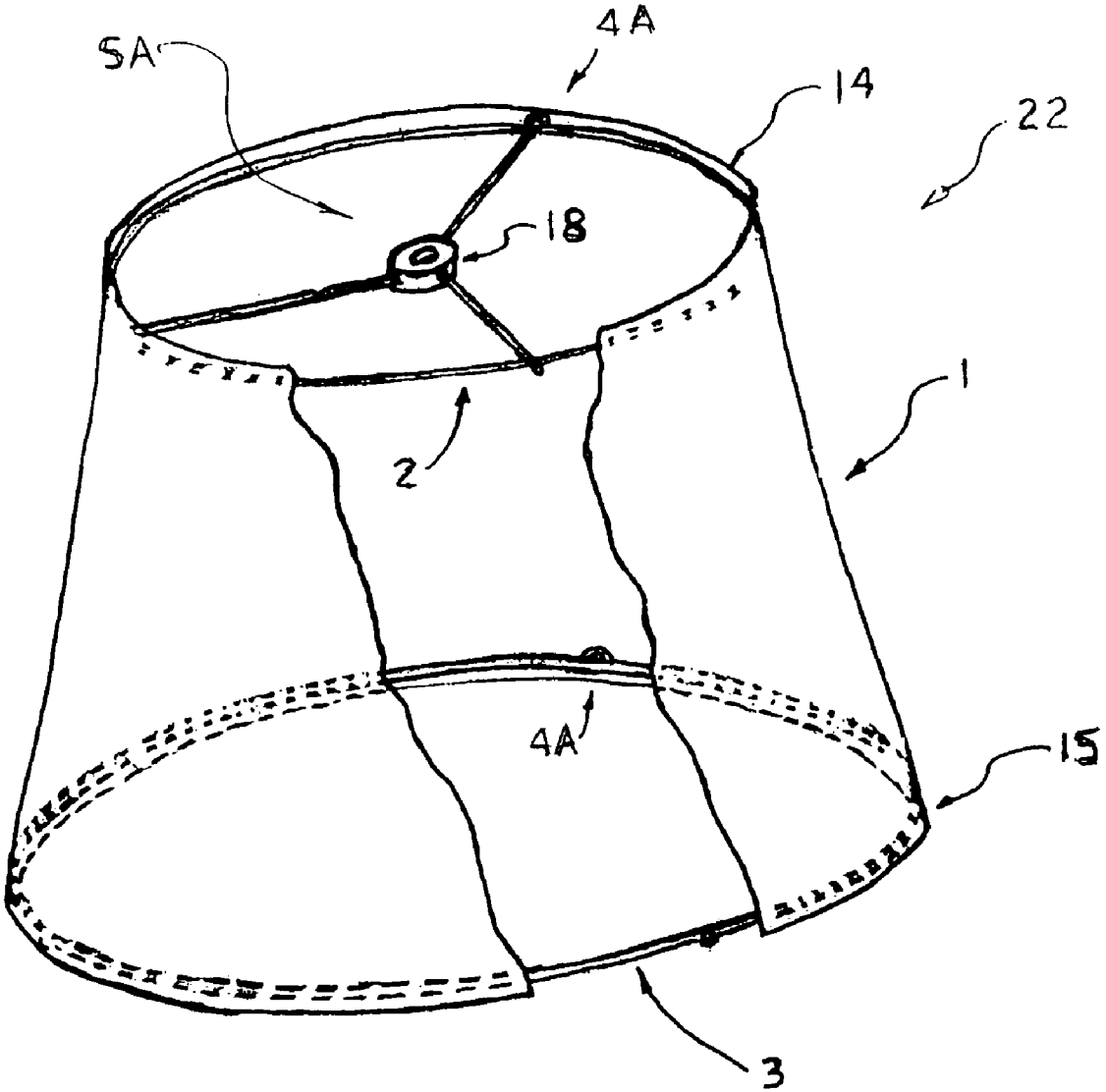
FIG. 3 is an illustration of the first embodiment of the composite lampshade with the planar mounting spider installed on the upper ring.

In an example of an arrangement of a composite shade utilizing combinations of the above primary and secondary components, as shown in FIG. 3 the lampshade 22 comprises cover 1, upper ring 2 and lower ring 3. The first embodiment of mounting spider 5A is shown attached to upper ring 2. Upper ring 2 is installed at upper edge 14 of the shade with its fixing nub seated in socket 4A. Positioning of ring 2 within edge 14 creates tension therein, which in turn holds the ring's fixing nubs in place within the sockets. Lower ring 3 is installed at lower edge 15 of the shade with its fixing nub seated in another socket 4A. Positioning of ring 3 within edge 15 creates tension therein, which in turn holds the ring's fixing nubs in place within the sockets.

The invention is described above in terms of various embodiments of its primary and secondary components and describes an arrangement of the invention comprising a composite lampshade utilizing a single combination of those embodiments. As will be appreciated by one skilled in the art, many other combinations of the described cover, rings, ring holders and mounting spiders may be utilized to produce a series of different composite lampshades without departing from the teachings of the invention.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

What is claimed is:

1. A collapsible lampshade, comprising:

an upper ring;

a lower ring;

each of said upper and lower rings comprising a circular band, deformed with planar indentations at a plurality of locations and fixing nubs permanently attached to said rings within said indentations:

a cover having an upper and a lower edge wherein:

said edges have respective inside surfaces;

wherein said cover has an interior area between said upper and lower inside surfaces; and wherein said cover has at least one longitudinal seam between said edges engaging two ends of at least one cover section;

a plurality of ring holders associated with said respective inside surfaces, creating respective upper and lower ring holders, and including sockets having socket holes oriented toward said interior area of said cover; and a mounting spider having a mounting hub and a plurality of legs permanently attachable to one of said upper and lower rings;

wherein, to assemble said collapsible lampshade said upper and lower rings are placed along said inside surfaces of said respective upper and lower edges and are fixed thereto by engaging said respective upper and lower ring holders with said upper and lower rings, wherein;

said engaging said respective upper and lower ring holders with said upper and lower rings comprises placing said fixing nubs into said respective socket holes when said upper and lower rings are placed against said respective upper and lower edges.

2. The collapsible lampshade of claim 1, wherein:

said upper and lower edges are of a diametric size, relative to said corresponding upper and lower rings, so as to create tension within said edges when said rings are placed along said inside surfaces, and wherein said tension holds said upper and lower rings in position within said corresponding upper and lower ring holders.

3. The collapsible lampshade of claim 1, wherein said collapsible lampshade forms its intended shape when said rings are placed along said inside surfaces.

4. The collapsible lampshade of claim 1, wherein said collapsible lampshade collapses when said upper and lower rings are removed from along said inside surfaces of said upper and lower edges of said cover.

5. The collapsible lampshade of claim 1, wherein said cover is made of relatively stiff material and that said lampshade is self-supporting when said upper and lower rings are placed along said inside surfaces of said upper and lower edges with said upper and lower rings engaged with said corresponding upper and lower ring holders.

6. The collapsible lampshade of claim 1 wherein:

said legs of said mounting spider may project away from said mounting hub in one of an upward or downward conical arrangement with said mounting hub defining a vertex of said arrangement; and said mounting hub is located within said interior area of said cover with said spider permanently affixed to either one of said upper or lower rings and said lampshade is assembled.

7. The collapsible lampshade of claim 1 wherein:

said upper and lower rings comprise circular bands having a diameter;

said ring holders comprise clips having upper and lower jaws spaced apart at a distance of said diameter and oriented toward said interior area of said cover; and said engaging said respective upper and lower ring holders with said upper and lower rings comprises placing said bands in between said respective jaws when said upper and lower rings are placed against said respective upper and lower edges.

8. The collapsible lampshade of claim 1 wherein said engaging two ends of at least one cover section of a longitudinal seam comprises an overlap of said two ends with said overlap being permanently engaged by gluing.

9. The collapsible lampshade of claim 1 wherein said engaging two ends of at least one cover section of a longitudinal seam comprises interweaving two sides of an alternating, opposing-flap interlocking system.

10. The collapsible lampshade of claim 1 wherein said lower ring comprises at least two radially curved sections with mating ends held together by a connection device.

11. The collapsible lampshade of claim 10 wherein said connection device comprises a connection tube having an inner diameter which, when placed over said mating ends, securely surrounds said ends, holding said ends together.

12. A collapsible lampshade, comprising:

an upper ring;

a lower ring;

a cover having an upper and a lower edge wherein:

said edges have respective inside surfaces;

wherein said cover has an interior area between said upper and lower inside surfaces; and wherein said cover has at least one longitudinal seam between said edges engaging two ends of at least one cover section;

a plurality of ring holders associated with said respective inside surfaces, creating respective upper and lower ring holders, and a mounting spider having a mounting hub and a plurality of legs permanently attachable to one of said upper and lower rings;

wherein, to assemble said collapsible lampshade said upper and lower rings are placed along said inside surfaces of said respective upper and lower edges and are fixed thereto by engaging said respective upper and lower ring holders with said upper and lower rings, wherein:

each of said upper and lower rings comprise a circular band, deformed with planar indentations at a plurality of locations and having a diameter;

fixing nubs are permanently attached to said rings within said indentations;

said ring holders comprise sockets having socket holes oriented toward said interior area of said cover and clips having upper and lower jaws spaced apart at a distance of said diameter and oriented toward said interior area of said cover; and said engaging said respective upper and lower ring holders with said upper and lower rings comprises:

placing said fixing nubs into said respective socket holes; and placing said bands in between said respective jaws when said upper and lower rings are placed against said respective upper and lower edges.

* * * * *